US007066671B2

(12) United States Patent
Ahne et al.

(10) Patent No.: US 7,066,671 B2
(45) Date of Patent: Jun. 27, 2006

(54) METHOD FOR FORMING PERFORATIONS IN A SHEET OF MEDIA WITH A PERFORATION SYSTEM

(76) Inventors: Adam Jude Ahne, 3213 Pepperhill rd., Lexington, KY (US) 40502; Mark Joseph Edwards, 3277 Hunting Hills Dr., Lexington, KY (US) 40515

( * ) Notice: Subject to any disclaimer, the term of this patent is extended or adjusted under 35 U.S.C. 154(b) by 130 days.

(21) Appl. No.: 10/612,771

(22) Filed: Jul. 2, 2003

(65) Prior Publication Data

US 2005/0001891 A1 Jan. 6, 2005

(51) Int. Cl.
*B41J 11/27* (2006.01)

(52) U.S. Cl. ..... 400/621; 347/104

(58) Field of Classification Search ..... 400/621; 347/104; 358/1.1–1.3; 428/43
See application file for complete search history.

(56) References Cited

U.S. PATENT DOCUMENTS

| | | | | |
|---|---|---|---|---|
| 3,804,325 | A | 4/1974 | Potter | |
| 4,100,867 | A | 7/1978 | Bass et al. | 112/270 |
| 4,250,780 | A | 2/1981 | Shimizu et al. | |
| 4,257,291 | A | 3/1981 | Buchmann | 83/71 |
| 4,467,525 | A | 8/1984 | Logan et al. | 33/18 B |
| 4,541,337 | A | 9/1985 | Schaul | 101/227 |
| 4,604,632 | A | 8/1986 | Matsumoto | 346/24 |
| 4,653,942 | A | 3/1987 | Soloveychik et al. | 400/122 |
| 4,794,542 | A | 12/1988 | Prockter et al. | 364/474.02 |
| 4,836,697 | A | 6/1989 | Plotnick et al. | 400/120 |
| 5,000,812 | A | 3/1991 | Murphy | |
| 5,219,183 | A | 6/1993 | McKillip | |
| 5,275,077 | A | 1/1994 | Kobayashi | 83/880 |
| 5,401,110 | A | 3/1995 | Neeley | |
| 5,526,744 | A | 6/1996 | Meschi | |
| 5,531,530 | A | 7/1996 | Kuramoto et al. | |
| 5,560,725 | A | 10/1996 | Abergel | |
| 5,720,223 | A | 2/1998 | Meschi | |
| 5,776,297 | A | 7/1998 | Edwards et al. | |
| 5,823,691 | A | 10/1998 | Langner | 400/127 |
| 5,823,692 | A | 10/1998 | Tolrud et al. | |
| 5,842,794 | A * | 12/1998 | Zimmermann | 400/138.1 |
| 5,846,005 | A | 12/1998 | Britz et al. | |
| 5,853,837 | A | 12/1998 | Popat | |
| 5,997,680 | A | 12/1999 | Popat | |
| 6,105,483 | A | 8/2000 | Takeda | 83/881 |
| 6,302,602 | B1 | 10/2001 | Kiyohara et al. | |
| 6,334,675 | B1 | 1/2002 | Sanada et al. | 347/95 |
| 6,341,548 | B1 | 1/2002 | Hirahata et al. | 83/881 |
| 6,408,132 | B1 | 6/2002 | Ishikawa | |
| 6,491,361 | B1 | 12/2002 | Spann | |
| 6,554,511 | B1 | 4/2003 | Kwasny et al. | |
| 6,594,026 | B1 | 7/2003 | MacDonald | 358/1.12 |
| 6,619,166 | B1 | 9/2003 | Miyazaki et al. | 83/13 |
| 6,652,171 | B1 * | 11/2003 | Onishi | 400/621 |

(Continued)

*Primary Examiner*—Minh Chau
(74) *Attorney, Agent, or Firm*—Taylor & Aust

(57) ABSTRACT

A method for forming perforations in a sheet of media with a perforation system includes the steps of generating graphics data; defining a non-printed color to represent perforation locations; embedding the non-printed color in the graphics data for a current perforation job; providing an identifier for identifying the non-printed color in the graphics data; read the graphics data including the non-printed color; using the identifier, identifying a plurality of perforation locations based on the non-printed color; and performing perforation of the sheet of media in accordance with the identifying step.

22 Claims, 12 Drawing Sheets

U.S. PATENT DOCUMENTS 6,694,854 B1 2/2004 Furuya ..... 83/879
6,926,400 B1 8/2005 Kelley ..... 347/104
2001/0054339 A1 12/2001 Nokelainen
2002/0113986 A1 8/2002 MacDonald
2003/0206211 A1 11/2003 Baron ..... 347/37
2004/0085422 A1 5/2004 Kelley ..... 347/101

* cited by examiner

METHOD FOR FORMING PERFORATIONS IN A SHEET OF MEDIA WITH A PERFORATION SYSTEM

BACKGROUND OF THE INVENTION

1. Field of the Invention

The present invention relates to perforating a sheet of media, and, more particularly, to a method for forming perforations in a sheet of media with a perforation system.

2. Description of the Related Art

Various devices are available for performing perforation and/or cutting operations. However, many such devices are used in commercial applications, and are generally cost prohibitive to lower volume users. Also, such devices are often standalone devices, requiring the purchase of additional hardware. While some efforts have been directed to incorporating perforation or cutting devices into an imaging device, there still exists a need for a versatile imaging apparatus and associated method that enables low volume users to enjoy the benefits of perforation.

SUMMARY OF THE INVENTION

In one form thereof, the invention relates to a method for forming perforations in a sheet of media with a perforation system, including the steps of generating graphics data; defining a non-printed color to represent perforation locations; embedding the non-printed color in the graphics data for a current perforation job; providing an identifier for identifying the non-printed color in the graphics data; read the graphics data including the non-printed color; using the identifier, identifying a plurality of perforation locations based on the non-printed color; and performing perforation of the sheet of media in accordance with the identifying step.

In another form thereof, the invention relates to a perforation system for forming perforations in a sheet of media. The system includes a computer configured to perform the steps of generating graphics data; embedding a non-printed color in the graphics data for a current perforation job, the non-printed color representing perforation locations; and providing an identifier for identifying the non-printed color in the graphics data. An apparatus is communicatively coupled to the computer. The apparatus is configured to perform the steps of reading the graphics data including the non-printed color; using the identifier, identifying a plurality of perforation locations based on the non-printed color; and performing perforation of the sheet of media in accordance with the identifying and adjusting steps.

In another form thereof, the invention relates to a method for forming perforations in a sheet of media with a perforation system, including the steps of scanning an image formed on a medium to generate graphics data; identifying to the perforation system a plurality of perforation locations associated with the graphics data for a current perforation job; adjusting parameters of a perforation apparatus in accordance with the current perforation job; and performing perforation of the sheet of media in accordance with the identifying and adjusting steps.

In another form thereof, the invention relates to a perforation system for forming perforations in a sheet of media. The system includes a scanner for scanning an image formed on a medium to generate graphics data. A computer is communicatively coupled to the scanner. The computer is configured to identify a plurality of perforation locations associated with the graphics data for a current perforation job. An apparatus is communicatively coupled to the computer. The apparatus includes a perforation mechanism. The apparatus is configured for performing the steps of adjusting perforation parameters in accordance with the current perforation job; and perforating the sheet of media in accordance with the adjusting step.

In another form thereof, the invention relates to a method for carrying out combined printing and perforating of a sheet of print media, including the steps of (a) formatting graphics data into a plurality of print swaths for printing by a printhead on the sheet of print media; (b) associating perforation coordinates defining a plurality of perforation locations with the plurality of print swaths, for perforation by a perforation mechanism; (c) determining whether a first print swath of the plurality of print swaths includes any perforation locations; (d) performing at least one of the printing and the perforating at the first print swath; (e) advancing the sheet of print media by a predetermined distance less than a height of the printhead; (f) determining whether a next print swath of the plurality of print swaths includes any perforation locations; and (g) performing at least one of the printing and the perforating at the next print swath.

In another form thereof, the invention relates to an apparatus including a carrier system configured to carry a printhead and a perforation forming mechanism. A control unit is configured to perform the steps of (a) formatting graphics data into a plurality of print swaths for printing by the printhead; (b) associating perforation coordinates defining a plurality of perforation locations with the plurality of print swaths, for perforation by a perforation mechanism; (c) determining whether a first print swath of the plurality of print swaths includes any perforation locations; (d) performing at least one of the printing and the perforating at the first print swath; (e) advancing the sheet of print media by a predetermined distance less than a height of the printhead; (f) determining whether a next print swath of the plurality of print swaths includes any perforation locations; and (g) performing at least one of the printing and the perforating at the next print swath.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION OF THE INVENTION

Figure 1:
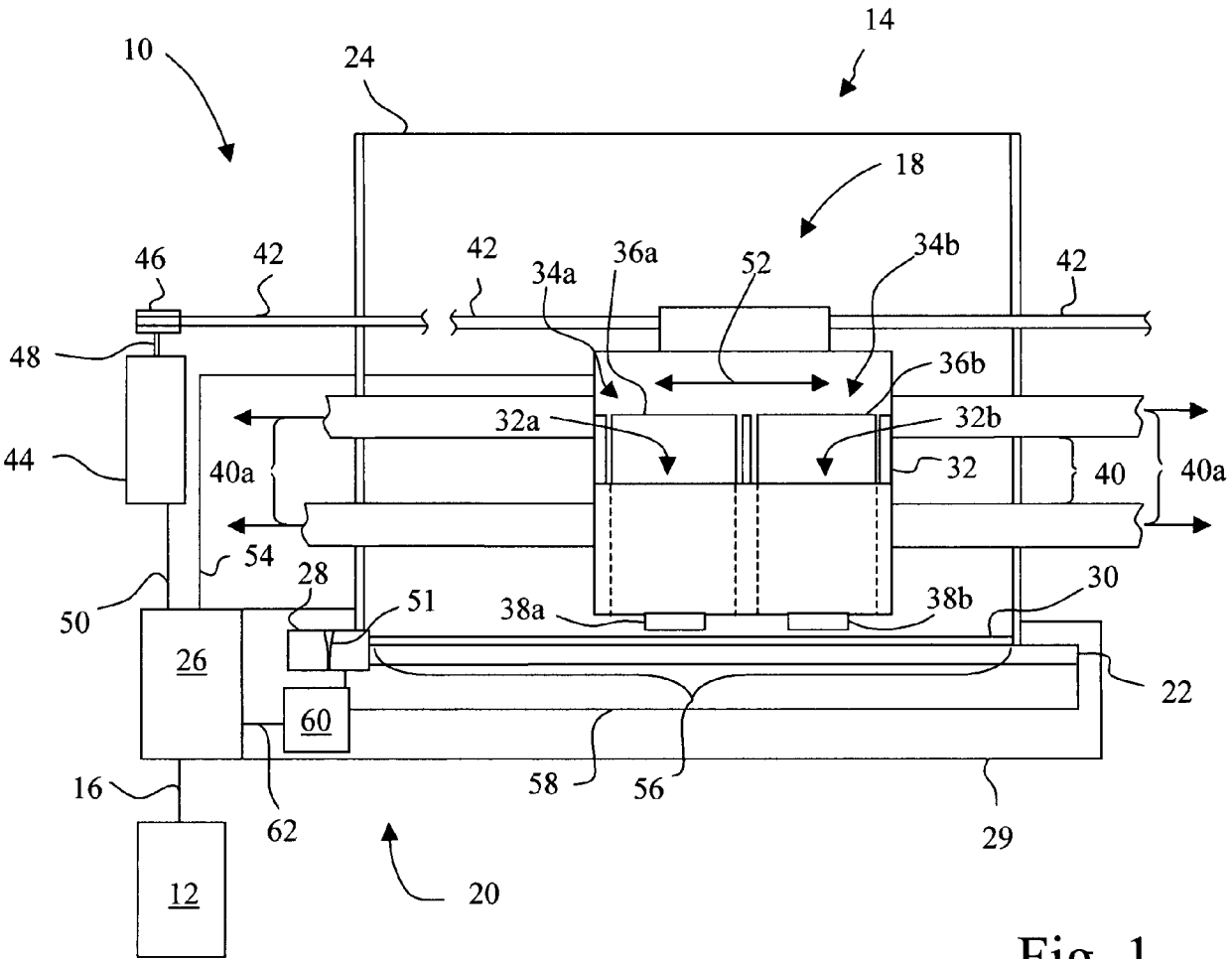
FIG. 1 is a diagrammatic representation of an imaging system employing an embodiment of the present invention.

Referring now to the drawings and particularly to FIG. 1, there is shown an imaging system 10 employing an embodiment of the present invention. Imaging system 10 includes a computer 12 and an imaging apparatus in the form of an ink jet printer 14. Computer 12 is communicatively coupled to ink jet printer 14 by way of communications link 16. Communications link 16 may be, for example, a wired connection, an optical connection, such as an optical or r.f. connection, or a network connection, such as an Ethernet Local Area Network.

Computer 12 is typical of that known in the art, and may include a monitor to display graphics or text, an input device such as a keyboard and/or mouse, a microprocessor and associated memory, such as random access memory (RAM), read only memory (ROM) and a mass storage device, such as CD-ROM or DVD hardware. Resident in the memory of computer 12 is printer driver software. The printer driver software places print data and print commands in a format that can be recognized by ink jet printer 14.

Ink jet printer 14 includes a carrier system 18, a feed roller unit 20, a mid-frame 22, a media source 24, a controller 26 and a perforator maintenance station 28. Carrier system 18, feed roller unit 20, mid-frame 22, media source 24, controller 26 and perforator maintenance station 28 are coupled, e.g., mounted, to an imaging apparatus frame 29.

Media source 24 is configured and arranged to supply from a stack of print media a sheet of print media 30 to feed roller unit 20, which in turn further transports the sheet of print media 30 during a printing operation and/or a perforation operation.

Carrier system 18 includes a carrier 32, i.e., carriage, that is configured with one or more bays, for example bay 32*a* and bay 32*b*. Each of bays 32*a*, 32*b* is mechanically and electrically configured to mount, carry and facilitate one or more types of cartridges, such as a monochrome printhead cartridge 34*a* and/or a color printhead cartridge 34*b*, and/or a perforator cartridge 34*c* (see FIGS. 2A–2D). Monochrome printhead cartridge 34*a* includes a monochrome ink reservoir 36*a* provided in fluid communication with a monochrome ink jet printhead 38*a*. Color printhead cartridge 34*b* includes a color ink reservoir 36*b* provided in fluid communication with a color ink jet printhead 38*b*. Alternatively, ink reservoirs 36*a*, 36*b* may be located off-carrier, and coupled to respective ink jet printheads 38*a*, 38*b* via respective fluid conduits. Perforator cartridge 34*c* is sized and configured to be mechanically and electrically compatible with the configuration of at least one of the printhead cartridges 34*a*, 34*b* so as to be interchangeable therewith in carriage 32, and includes a perforation forming mechanism 39.

Carriage 32 is guided by a pair of guide members 40. Either, or both, of guide members 40 may be, for example, a guide rod, or a guide tab formed integral with imaging apparatus frame 29. The axes 40*a* of guide members 40 define a bi-directional scanning path 52 of carriage 32. Carriage 32 is connected to a carrier transport belt 42 that is driven by a carrier motor 44 via a carrier pulley 46. In this manner, carrier motor 44 is drivably coupled to carriage 32 via carrier transport belt 42, although one skilled in the art will recognize that other drive coupling arrangements could be substituted for the example given, such as for example, a worm gear drive. Carrier motor 44 can be, for example, a direct current motor or a stepper motor. Carrier motor 44 has a rotating motor shaft 48 that is attached to carrier pulley 46. Carrier motor 44 is coupled, e.g., electrically connected, to controller 26 via a communications link 50.

Perforator maintenance station 28 includes an abrasive member 51, such as a ceramic material, arranged to receive and sharpen a perforation device, such as for example, a needle or a blade.

At a directive of controller 26, carriage 32 is transported in a controlled manner along bi-directional scanning path 52, via the rotation of carrier pulley 46 imparted by carrier motor 44. During printing, controller 26 controls the movement of carriage 32 so as to cause carriage 32 to move in a controlled reciprocating manner, back and forth along guide members 40. In order to conduct perforator maintenance operations, e.g., sharpening, controller 26 controls the movement of carriage 32 to position printhead carrier in relation to perforator maintenance station 28. The ink jet printheads 38*a*, 38*b*, or alternatively perforation forming mechanism 39, are electrically connected to controller 26 via a communications link 54. Controller 26 supplies electrical address and control signals to ink jet printer 14, and in particular, to the ink jetting actuators of ink jet printheads 38*a*, 38*b*, to effect the selective ejection of ink from ink jet printheads 38*a*, 38*b*, or to perforation forming mechanism 39 to effect the selective actuation of perforation forming mechanism 39.

During a printing operation, the reciprocation of carriage 32 transports ink jet printheads 38*a*, 38*b* across the sheet of print media 30 along bi-directional scanning path 52, i.e., a scanning direction, to define a print zone 56 of ink jet printer 14. Bi-directional scanning path 52, also referred to as scanning direction 52, is parallel with axes 40*a* of guide members 40, and is also commonly known as the horizontal direction. During each scan of carriage 32, the sheet of print media 30 is held stationary by feed roller unit 20. Feed roller unit 20 includes a feed roller 58 and a drive unit 60. The sheet of print media 30 is transported through print zone 56 by the rotation of feed roller 58 of feed roller unit 20. A rotation of feed roller 58 is effected by drive unit 60. Drive unit 60 is electrically connected to controller 26 via a communications link 62.

Figure 2A:
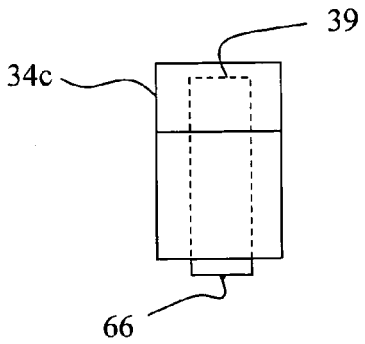
FIG. 2A shows an end view of an embodiment of the perforator cartridge of the present invention.
Figure 2B:
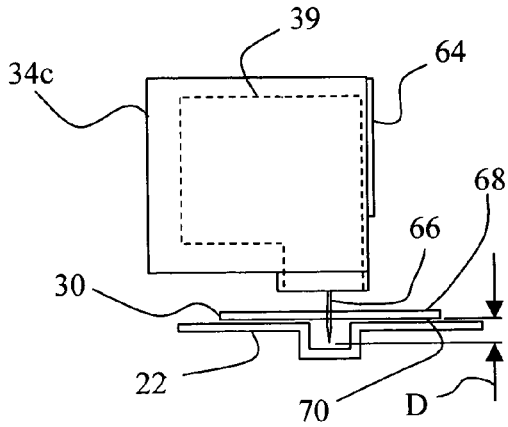
FIG. 2B shows a side view of the perforator cartridge of FIG. 2A.

FIG. 2A shows an end view of an embodiment of perforator cartridge 34*c*, including perforation forming mechanism 39. FIG. 2B shows a side view of an embodiment of perforator cartridge 34*c*, including perforation forming mechanism 39, and shows an electrical interface 64, such as a tape automated bonded (TAB) circuit.

Perforation forming mechanism 39 includes at least one perforation device 66, which may include one or more needles or blades used in forming perforations in the sheet of print media 30. FIG. 2A shows perforation device 66 with a single needle (or blade) exposed, but in a retracted position. FIG. 2B shows perforation device 66 in relation to the sheet of print media 30 having a front side 68 and a back side 70, with back side 70 being supported by mid-frame 22. As shown in FIG. 2B, perforation device 66 has one needle (or blade) exposed, and extending through the sheet of print media 30 by a distance D, as measured from the back side 70 of the sheet of print media 30. Distance D may be, for example, 0.1 millimeters or greater. Depending on the shape of perforation device 66, such as if perforation device is a tapered needle, the distance that perforation device 66 extends through the sheet of print media 30 can effect the size of the perforation opening. Thus, controller 26 may control perforation forming mechanism 39 to drive perforation device 66 at selectable distances D in order to select a particular perforation opening size. Further, by controlling the distance D, perforation forming mechanism 39 can be used to create Braille indicia on the sheet of print media 30, which may be, for example, a transparency sheet or paper. For example, when perforation device 66 is driven through a transparency sheet, a volcano-shaped raised surface is formed on the back side of the transparency sheet.

Figure 2C:
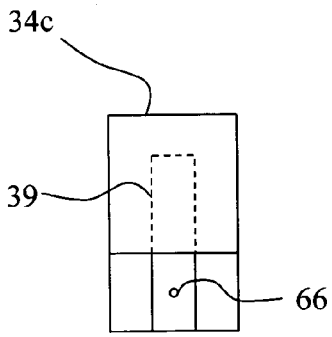
FIG. 2C shows a bottom view of one embodiment of the perforator cartridge of FIG. 2A.
Figure 2D:
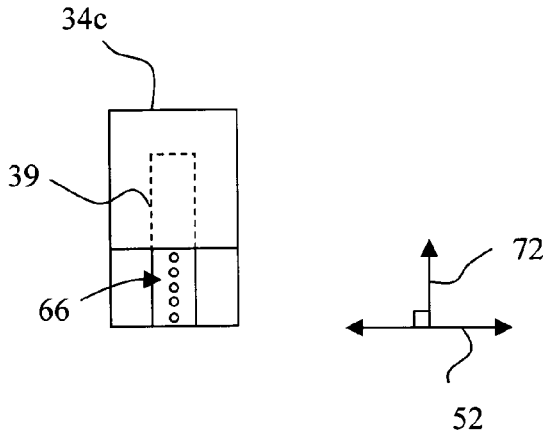
FIG. 2D shows a bottom view of another embodiment of the perforator cartridge of FIG. 2A.

Referring now to FIGS. 2C and 2D, perforation cartridge 34*c* can be configured having a single perforation device 66, as depicted in FIG. 2C, or alternatively, may be configured as depicted in FIG. 2D to have multiple perforation devices 66, e.g., multiple needles or blades, arranged, for example, in a column in a print media feed direction 72. Those skilled in the art will recognize that the multiple perforation devices 66 may be arranged in configurations other than a columnar arrangement, such as for example, slanted, staggered, curved, etc.

During a perforation operation, the reciprocation of carriage 32 transports perforator cartridge 34*c*, including perforation forming mechanism 39, across the sheet of print media 30 along bi-directional scanning path 52, i.e., a scanning direction, to define a perforation zone corresponding to print zone 56 of ink jet printer 14, and for convenience will also be referred to using the element number 56, i.e., perforation zone 56. The sheet of print media 30 is transported in print media feed direction 72 through perforation zone 56 by the rotation of feed roller 58 of feed roller unit 20.

Accordingly, in one embodiment, where perforation forming mechanism 39 has only a single perforation device 66, e.g., a single needle, then the maximum vertical perforation resolution (i.e., in a direction perpendicular to bi-directional scanning path 52, e.g., in print media feed direction 72) is limited to the minimum indexing distance of feed roller 58, while the horizontal perforation resolution (parallel to bi-directional scanning path 52) may be controlled to be as high as the horizontal printing resolution of printheads 38*a*, 38*b*, or lower. However, the extent of each perforation formed in the sheet of print media 30 may be increased by using a blade as perforation device 66. As used herein, the term perforation resolution refers to the maximum number of perforation holes in a given distance of the media, such as perforations per inch (ppi).

In another embodiment, where perforation forming mechanism 39 has multiple perforation devices 66, e.g., multiple needles or blades, arranged in a column in the print media feed direction 72, then the maximum vertical perforation resolution and the horizontal perforation resolution may be controlled to be a high as the printing resolution of printheads 38*a*, 38*b*, or lower.

Controller 26 is communicatively coupled to perforation forming mechanism 39 via communications link 54 and electrical interface 64 of perforation cartridge 34*c*. Controller 26 is configured, via hardware, firmware or software, to select either or both of the vertical perforation resolution and the horizontal perforation resolution. Such a selection may be based, for example, on media type (e.g., plain paper, photo paper, stickers, plastic, etc.), media thickness, or a resolution selected by a user. Alternatively, the perforation resolution may be established by computer 12, with perforation resolution commands or data being sent from computer 12 to controller 26.

Figure 3A:
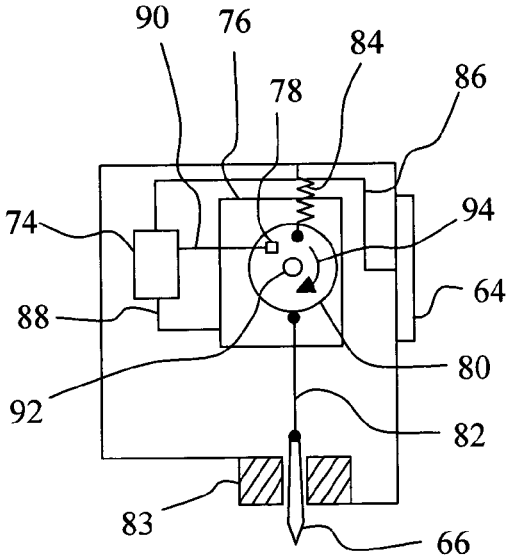
FIG. 3A is a diagrammatic representation of one embodiment of a perforation forming mechanism for the perforation cartridge of FIG. 2A.
Figure 3B:
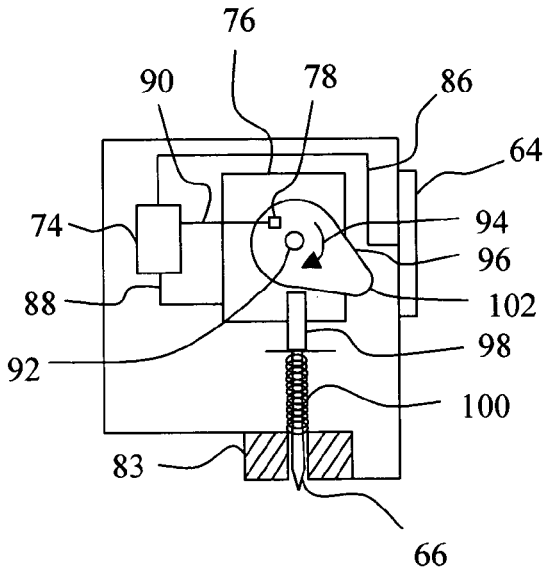
FIG. 3B is a diagrammatic representation of another embodiment of a perforation forming mechanism for the perforation cartridge of FIG. 2A.
Figure 3C:
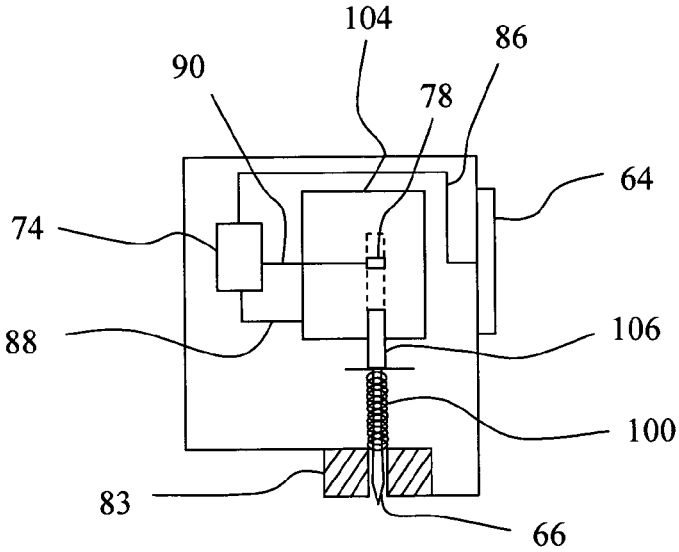
FIG. 3C is a diagrammatic representation of another embodiment of a perforation forming mechanism for the perforation cartridge of FIG. 2A.

FIGS. 3A, 3B and 3C show three exemplary embodiments of perforation forming mechanism 39, each of which is discussed below.

FIG. 3A shows perforation forming mechanism 39 including, in addition to perforation device 66, a control circuit 74, a motor 76, a sensor 78, a flywheel 80, a linkage 82, a guide bushing 83, and a biasing spring 84. Electrical interface 64 of perforation cartridge 34*c* is connected to control circuit 74 via a communication link 86, such as for example, a multi-wire cable. Alternatively, electrical interface 64 can be formed on one side of a two layer printed circuit board, and control circuit 74 can be mounted on the opposite side of the printed circuit board. Also, control circuit 74 is connected to motor 76 via a communication link 88, and control circuit 74 is connected to sensor 78 via a communication link 90. Communications links 88 and 90 may be, for example, a multi-wire cable.

Motor 76 includes a shaft 92 connected to flywheel 80. Linkage 82 is pivotably coupled to each of flywheel 80 and perforation device 66. Guide bushing 83 establishes an orientation of perforation device 66, and provides a low friction inner guide surface that contacts perforation device 66. Also, the bottom surface of guide bushing 83 will release perforation device 66 from the sheet of print media 30 as the perforation device 66 is retracted into guide bushing 83, if the sheet of print media 30 become stuck to perforation device 66 during perforation.

A stroke of perforation device 66 may be established based on the location on flywheel 80 where linkage 82 is pivotably attached. As shown, a full rotation of flywheel 80, such as in the clockwise direction 94 as shown, will result in a full cycle of perforation device 66, e.g., from the fully retracted position to the fully extended position, and back to the fully retracted position. Alternatively, a full cycle of perforation device 66 may be performed, for example, by a clockwise half-rotation of flywheel 80 to extend perforation device 66 from the fully retracted position to the fully extended position, followed by a return counter-clockwise half-rotation to return perforation device 66 from the fully extended position to the fully retracted position. As a further alternative, by stopping the rotation of flywheel 80 before perforation device 66 has reached its fully extended position, the distance D that perforation device 66 extends through the sheet of print media 30 (see FIG. 2B) can be selectably controlled. Such control can be effected, for example, by configuring controller 26 to select distance D and control the stroke of perforation device 66 accordingly.

Sensor 78 senses a position of flywheel 80, such as a position indicia or feature representing a home (fully retracted) position. Alternatively, the position indicia, or feature, can be located near the home position, but not at the home position, such that sensor 78 is tripped just before flywheel 80 is at its home position. Also, it is contemplated that multiple position indicia or features may be established around flywheel 80, thereby providing a finer detection of the position of perforation device 66, and in turn, enabling better control over the position of perforation device 66. Such a position indicia or feature may be formed from a material having contrasting characteristics to that of the remainder of flywheel 80. For example, flywheel 80 may have a highly reflective finish except for the position indicia or feature, which has a light absorbing finish. Thus, sensor 78 supplies a signal to control circuit 74 so as to stop rotation of shaft 92 of motor 76, and in turn stop the rotation of flywheel 80, when sensor 78 senses the position indicia or feature on flywheel 80.

Biasing spring 84 is pivotably coupled to flywheel 80, and is located to aid the retention of flywheel 80 in the home position, and in turn, to aid the retention of perforation device 66 in its home (fully retracted) position.

FIG. 3B shows another embodiment of perforation forming mechanism 39, wherein flywheel 80, linkage 82, and biasing spring 84 of FIG. 3A is replaced with a cam 96, a cam follower 98 and a spring 100. Electrical interface 64 of perforation cartridge 34*c* is connected to control circuit 74 via communication link 86, such as for example, a multi-wire cable. Also, control circuit 74 is connected to motor 76 via communication link 88, and control circuit 74 is connected to sensor 78 via communication link 90.

Shaft 92 of motor 76 connected to cam 96. Cam follower 98 is coupled, e.g., connected to or integral with, perforation device 66. Guide bushing 83 establishes an orientation of perforation device 66, and provides a low friction inner guide surface that contacts perforation device 66. A stroke of perforation device 66 may be established based on the location of a cam lobe 102 on cam 96 in relation to cam follower 98. As shown, a full rotation of cam 96, such as in the clockwise direction 94 as shown, will result in a full cycle of perforation device 66, e.g., from the fully retracted position to the fully extended position, and back to the fully retracted position. Alternatively, a full cycle of perforation device 66 may be performed, for example, by a clockwise half-rotation of cam 96 to extend perforation device 66 from the fully retracted position to the fully extended position, followed by a return counter-clockwise half-rotation that returns perforation device 66 from the fully extended position to the fully retracted position. As a further alternative, by stopping the rotation of cam 96 before perforation device 66 has reached its fully extended position, the distance D that perforation device 66 extends through the sheet of print media 30 can be selectably controlled. Such control can be effected, for example, by configuring controller 26 to select distance D and control the stroke of perforation device 66 accordingly.

Sensor 78 senses a position of cam 96, such as a position indicia or feature representing a home (fully retracted) position. Such a position indicia or feature may be formed from a material having contrasting characteristics to that of the remainder of cam 96. For example, cam 96 may have a highly reflective finish except for the position indicia or feature, which has a light absorbing finish. Thus, sensor 78 supplies a signal to control circuit 74 so as to stop rotation of shaft 92 of motor 76, and in turn stop the rotation of cam 96, when sensor 78 senses the position indicia or feature on cam 96.

Spring 100 is positioned between cam follower 98 and guide bushing 83 to aid in biasing perforation device 66 in its home (fully retracted) position.

FIG. 3C shows another embodiment of perforation forming mechanism 39, wherein the motor 76 and cam follower 98 of FIG. 3B is replaced with a solenoid 104 and an armature 106. Electrical interface 64 of perforation cartridge 34*c* is connected to control circuit 74 via communication link 86, such as for example, a multi-wire cable. Also, control circuit 74 is connected to solenoid 104 via communication link 88, and control circuit 74 is connected to sensor 78 via communication link 90.

Armature 106 is displaced linearly upon the actuation of solenoid 104. Armature 106 is coupled, e.g., connected to or integral with, perforation device 66. Guide bushing 83 establishes an orientation of perforation device 66, and provides a low friction inner guide surface that contacts perforation device 66. A full cycle of perforation device 66 may be established based on the actuation of solenoid 104 to move perforation device 66 from the fully retracted position to the fully extended position, followed by the de-actuation of solenoid 104 to move perforation device 66 with the biasing aid of spring 100 back to the fully retracted position.

Sensor 78 senses a position of armature 106, such as a position indicia or feature representing a home (fully retracted) position. Such a position indicia or feature may be formed from a material having contrasting characteristics to that of the remainder of armature 106. For example, armature 106 may have a highly reflective finish except for the position indicia or feature, which has a light absorbing finish. Thus, sensor 78 supplies a signal to control circuit 74 to indicate when sensor 78 senses the position indicia or feature on armature 106.

In the various embodiments of FIGS. 3A–3C, sensor 78 will detect when perforation device 66 is not in the fully retracted (home) position, thereby indicating an error condition in the event that perforation device 66 gets stuck in the sheet of print media 30, e.g., remains out of its home position when controller 26 expects perforation device 66 to have returned to the home position.

Figure 4:
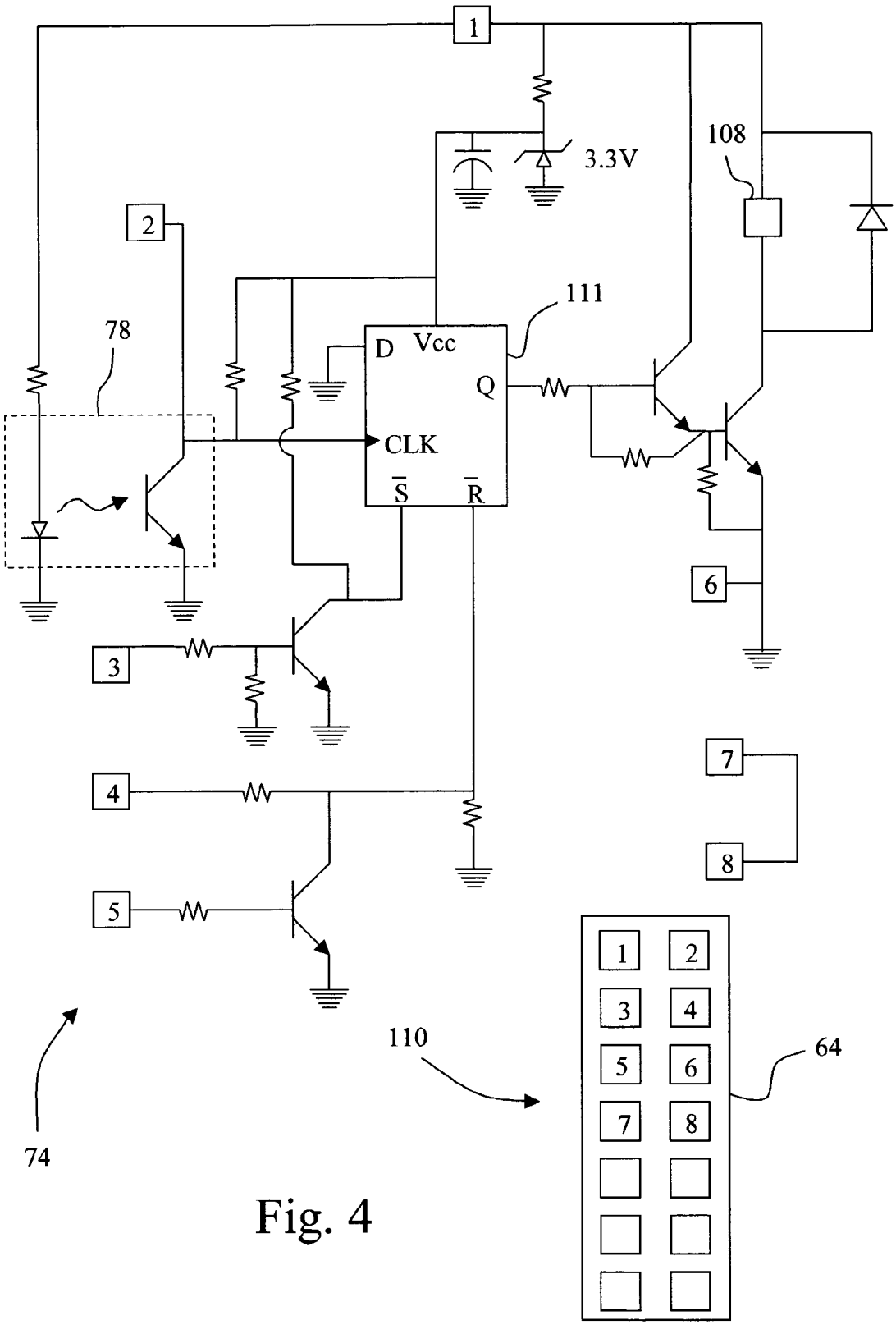
FIG. 4 is a circuit diagram of a control circuit that can be used in the various embodiments of the perforation forming mechanisms of FIGS. 3A–3C.

FIG. 4 is an exemplary circuit suitable for use as control circuit 74. Control circuit 74 includes sensor 78, various drive components, and a driven device 108. Driven device 108 represents motor 76 of the embodiments of FIGS. 3A and 3B, and represents solenoid 104 in the embodiment of FIG. 3C. As shown, electrical interface 64 includes a plurality of connection pads 110, with individual connection pads 110-1, 110-2, 110-3, 110-4, 110-5, 110-6, 110-7, and 110-8 being assigned connection points within control circuit 74. In control circuit 74, pads 110-7 and 110-8 are tied together, and in turn are used to indicate to controller 26 that cartridge 34*c* is in fact a perforation cartridge. Sensor 78 is used to supply a clock input to the D-flip-flop 111. Circuit power is supplied to control circuit 74 via pads 110-1 and 110-2. Controller 26 may set D-flip-flop 111 by supplying a signal to pad 110-3. Controller 26 may reset D-flip-flop 111 by supplying appropriate signals to pads 110-4 and 110-5. Circuit ground may be established, or may be monitored, via pad 110-6. Other aspects of the operation of control circuit 74, as shown in FIG. 4, are readily understood by one skilled in the art, and will not be further discussed herein.

Figure 5A:
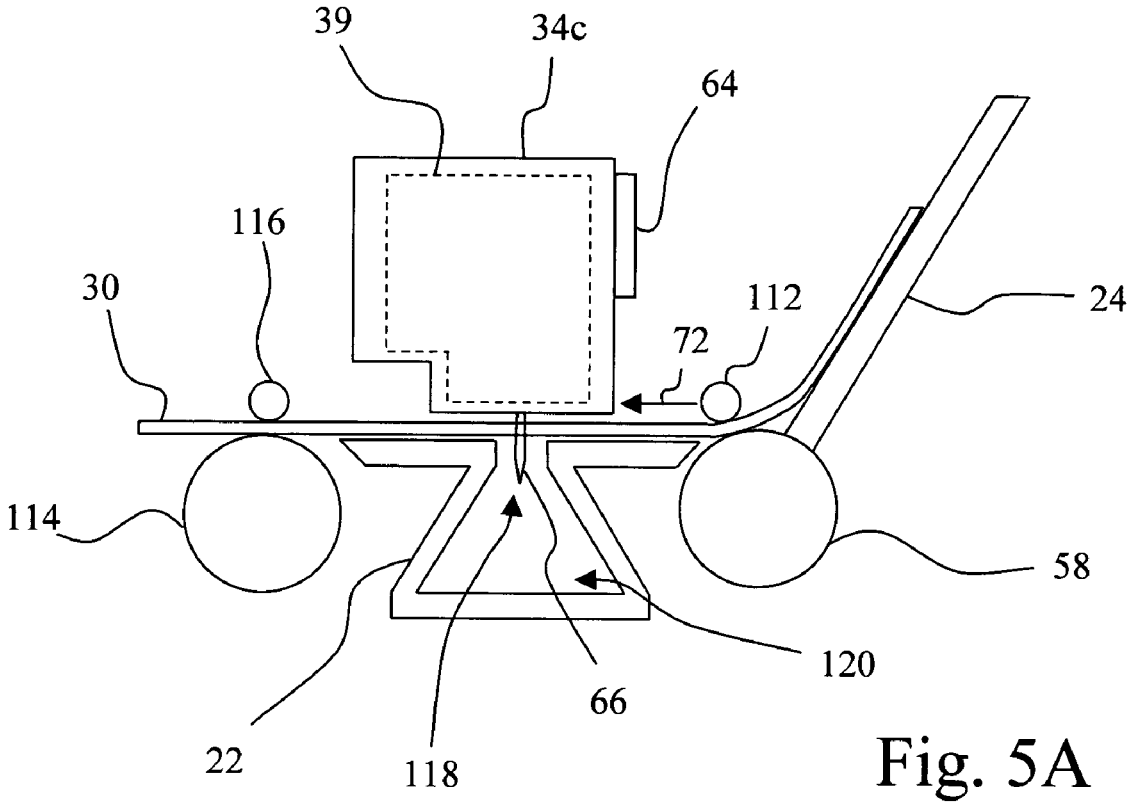
FIG. 5A is a side diagrammatic view of the mid-frame region of the imaging apparatus of FIG. 1.

FIG. 5A shows a side diagrammatic view of a portion of printer 14, illustrating a perforation of the sheet of print media 30. As shown, the sheet of print media 30 is transported by feed roller 58 with the aid of its associated pinch roller 112, and by an exit roller 114 with the aid of an associated pinch roller 116. Thus, feed roller 58 is positioned upstream of perforation device 66, in relation to print media feed direction 72. In addition, exit roller 114 is positioned downstream of perforation device 66. As such, in one embodiment the sheet of print media 30 is suspended between feed roller 58 and exit roller 114 during perforation, as shown. Mid-frame 22 provides support for the sheet of print media 30 during perforation. Mid-frame 22 includes a trough 118 that extends along a width of mid-frame 22, e.g., an elongated opening that extends along perforation zone 56, for receiving perforation device 66 as perforation device 66 passes completely through the sheet of print media 30. Mid-frame 22, including trough 118, defines an interior region 120 that may be used for the accumulation of waste paper punch-outs generated during perforation. Trough 118 is configured with a depth such that perforation device 66 does not contact mid-frame 22, i.e., does not contact the bottom of trough 118, when perforation device 66 is at a fully extended position.

Figure 5B:
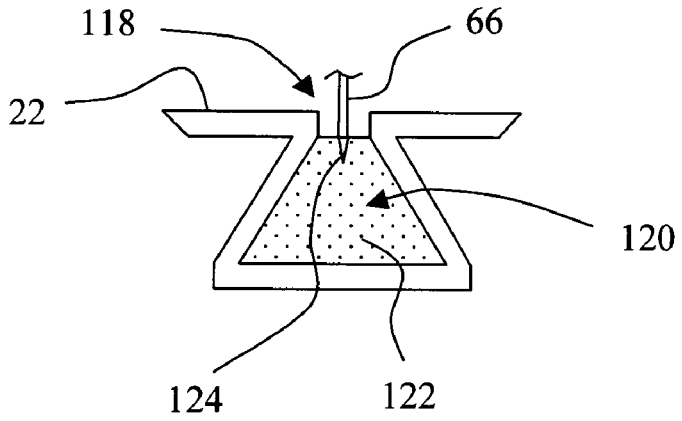
FIG. 5B is a side diagrammatic view showing another embodiment of the mid-frame of the imaging apparatus of FIG. 1.

Alternatively, as shown in FIG. 5B, interior region 120 may be substantially filled with a foam 122. Foam 122 may be positioned to receive at least a tip portion 124 of perforation device 66, thereby performing a cleaning of perforation device 66 after each perforation. Foam 122 may be, for example, a polyurethane foam or sponge. As a further alternative, interior region 120 may be completely filled with foam to provide support to back side 70 of the sheet of print media 30 at trough 118.

Figure 6:
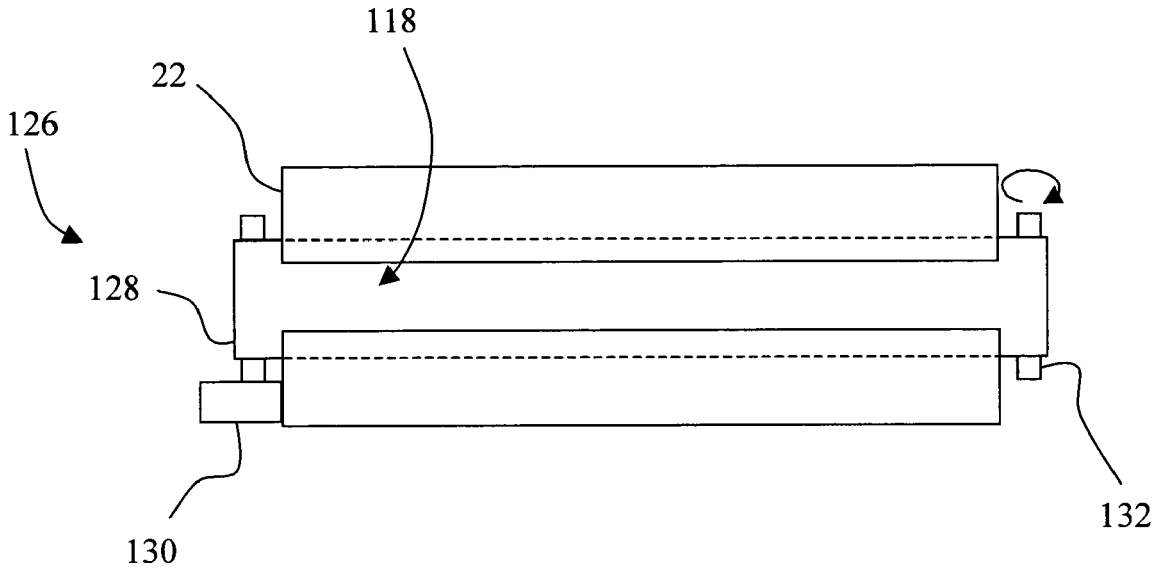
FIG. 6 is a top diagrammatic view showing still another embodiment of the mid-frame of the imaging apparatus of FIG. 1.

Referring now to FIG. 6, in relation to FIG. 5A, a conveyor unit 126 may be located in trough 118 in interior region 120 of mid-frame 22 to carry away the accumulation of waste paper punch-outs. Conveyer unit 126 includes a conveyor belt 128, a conveyor drive unit 130 and an idler unit 132. Conveyor belt 128 is suspended between conveyor drive unit 130 and an idler unit 132. Conveyor drive unit 130 provides a driving force to advance conveyor belt 128. Conveyor drive unit 130 may be, for example, a ratchet mechanism that increments conveyor belt 128 when conveyor drive unit 130 is engaged by carriage 32. Alternatively, conveyor drive unit 130 may be motor driven.

Figure 7:
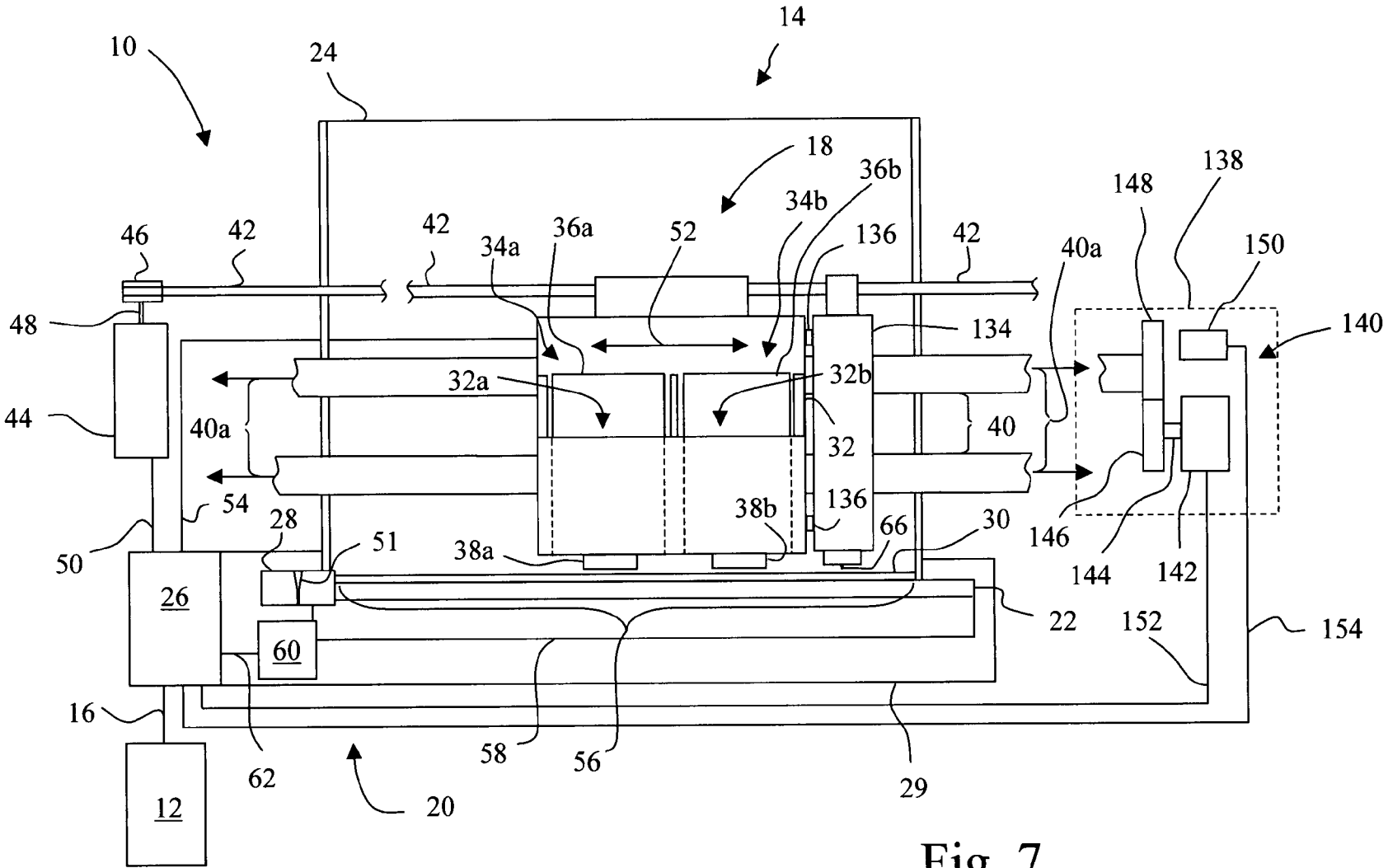
FIG. 7 is a diagrammatic representation of an imaging system employing another embodiment of the present invention.

FIG. 7 shows still another embodiment of the invention, which includes a dedicated perforator carriage 134. In this embodiment, carriage 32 may be a dedicated printhead carriage. The various configurations of the invention as shown in FIGS. 5A, 5B and 6, as well as the perforation operating characteristics described above, can also be readily incorporated into the embodiment of FIG. 7. Perforator carriage 134 is connected to carrier transport belt 42, and is coupled to carriage 32 by isolation members 136. Isolation members 136 may be made, for example, of rubber or other material having elastic, vibration absorbing, characteristics. Carrier transport belt 42 may also act as an isolation member. Perforator carriage 134 may be adapted to carry a perforation forming mechanism, such as for example one of the perforations forming mechanisms described above with respect to FIGS. 3A–3C, or another perforation mechanism known in the art. As shown, perforator carriage travels with carriage 32 carrying printheads 38*a*, 38*b* in a unitary manner. However, isolation members 136 serve as isolation dampers so that operation of the perforator mechanism in perforator carriage 134 will not transmit mechanical vibrations directly to carriage 32, and in turn to printheads 38*a*, 38*b*.

Alternatively, as shown in the breakout section 138, the perforation forming mechanism in perforator carriage 134 may be driven by a perforation drive system 140. Perforation drive system 140 includes a motor 142 having a shaft 144 to which a gear 146 is attached. A second gear 148 is attached to one of the guide members 40. This particular guide member may be a guide rod having a D-shaped cross section, which when rotated emulates the operation of cam 96 of FIG. 3B to drive perforation device 66. Gears 146, 148 are located to be in meshed relation. Also shown is a sensor 150 that is used to detect the home position of D-shaped shaft 40. Motor 142 is electrically connected to controller 26 via a communication link 152. Sensor 150 is electrically connected to controller 26 via communication link 154.

In this embodiment, controller 26 provides perforation commands to motor 142, which responds by rotating D-shaped guide member 40, which drives the perforation forming mechanism in perforator carriage 134, which in turn causes perforation device 66 to extend from its home position to its perforation position. Further rotation of D-shaped guide member 40 results in perforation device 66 returning to its retracted (home) position, wherein sensor 150 provides a signal to controller 26 to turn off motor 142 to stop rotation of D-shaped guide member 40.

The discussion that follows is directed to describing various methods of the invention. Referring to the embodiment of FIG. 1, when perforator cartridge 34*c* is installed in carriage 32, imaging system 10 is converted into a dual use system, serving both as an imaging system and a perforation system and with imaging apparatus 14 serving as a perforation apparatus. Likewise, referring to the embodiment of FIG. 7, when imaging system 10 is modified to include perforator carriage 134, imaging system 10 is converted into a dual use system, serving both as an imaging system and a perforation system. Accordingly, in the discussions of the various methods of the invention that follow, sometimes for convenience reference will be made to a perforator system 10 to emphasize the perforation functionality of the system. Also, for convenience and ease of understanding, sometimes the methods of the invention will be described with reference to the embodiments of FIGS. 1 and 7. However, it is to be understood that the methods of the invention need not be limited to the embodiments of FIGS. 1 and 7.

Figure 8:
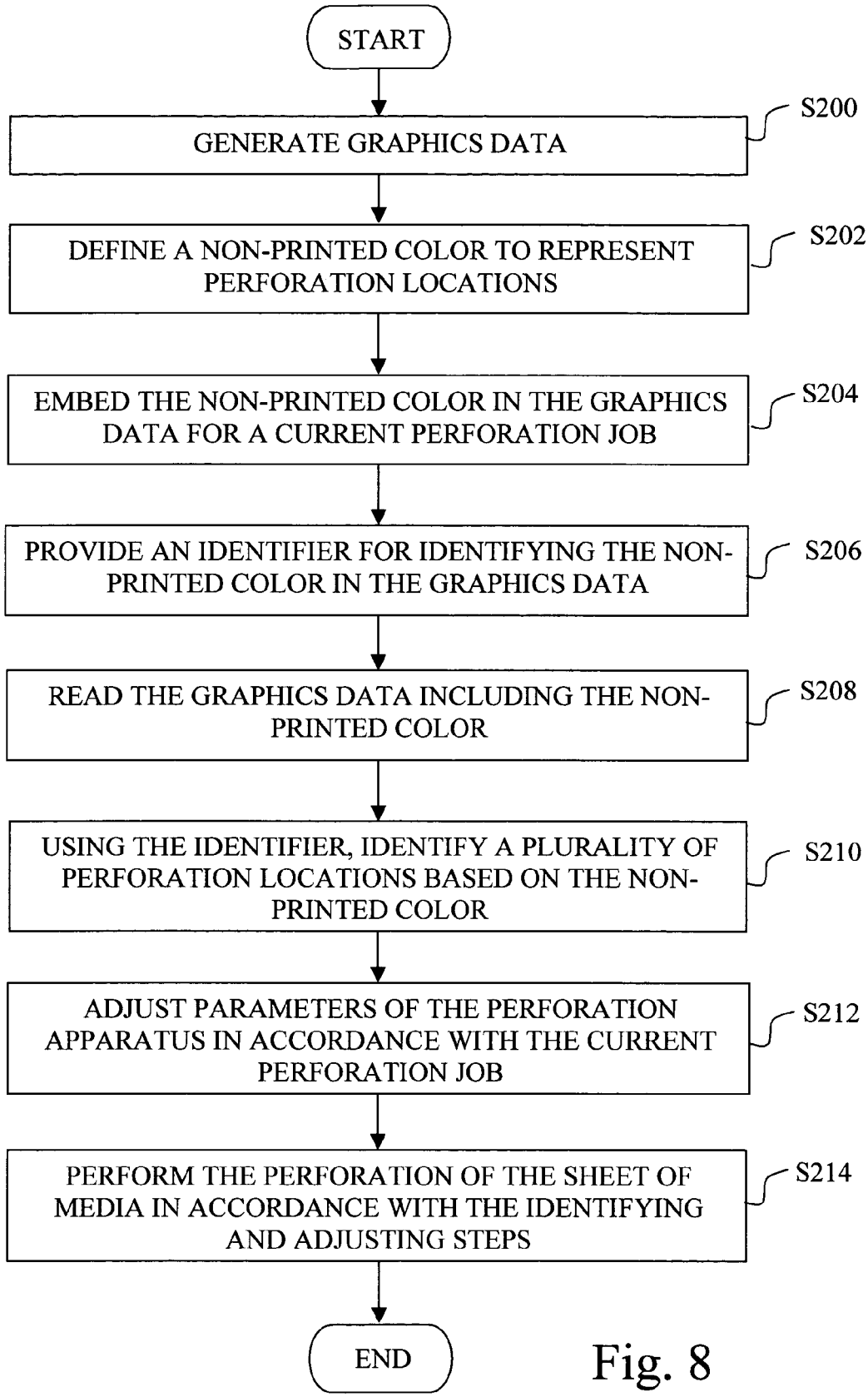
FIG. 8 is a flowchart of a method in accordance with the present invention.

FIG. 8 is directed to a method of forming perforations in sheet of media with a perforation system, such as perforation system 10 that was described above with respect to FIGS. 1–7.

At step S200, graphics data is generated, such as by computer 12 executing a graphics application. Such graphics data may represent, for example, image 160 shown in FIG. 9A.

At step S202, a non-printed color is defined to represent perforation locations.

In one exemplary implementation, the non-printed color may be identifiable by its presence with a predefined sequence of colors. For example, the occurrence of a predefined sequence of two or more colors indicate that the color proceeding, or alternatively following, the predefined sequence is a non-printed color, e.g., the perforation color, which in turn is used to identify perforation locations in the graphics data. For example, the printer driver operating on computer 12, or alternatively imaging apparatus 14, can be programmed to identify the color sequence in the print data and in turn identify the perforation color used to signify a perforation location. Colors may be repeated in the sequence.

As an example, it is predefined that a three pixel color group, beginning with a two color sequence will be followed by the non-printed color, i.e., the perforation color. The three color group may be, for example, a sequence of a yellow pixel and a light gray pixel, followed by a dark gray pixel as the perforation color. When the printer driver operating on computer 12, or alternatively a routine operating in imaging apparatus 14, detects the yellow-light gray sequence of pixels, then the following pixel, e.g., a dark gray pixel, is interpreted and saved, for example in memory associated with computer 12 or controller 26, as a non-printed color to be used as a perforation location identifier. Thereafter, each time the printer driver operating on computer 12, or alternatively imaging apparatus 14, detects a dark gray pixel, the dark gray pixel is identified as a non-printed color and its location by definition is a perforation location which will receive a perforation.

In the present embodiment, the term non-printed color is used to indicate the absence of color at the perforation location after perforation, and thus, not only covers the condition where the perforation location does not receive ink during a printing operation since the perforation will eliminate the material in the sheet of print media 30 at the perforation location, but is intended to also cover the condition wherein the perforation color is first printed, and then removed by the perforation.

In another exemplary implementation, computer 12 may analyze the color data associated with the graphics data, and select a color as the non-printed color that is absent with respect to the graphics data. The non-printed color would still be identified based on the color sequence method described above.

At step S204, the non-printed color is embedded in the graphics data for a current perforation job. Based on boundary information, computer 12, executing a program such as in the printer driver, automatically inserts the predefined color sequence proceeded (or alternatively followed) by the non-printed color, i.e., perforation color, into the graphics data, preferably near the beginning of the graphics data, and then embeds the non-printed color at locations corresponding to the perforation boundary specified by the user.

Figure 9A:
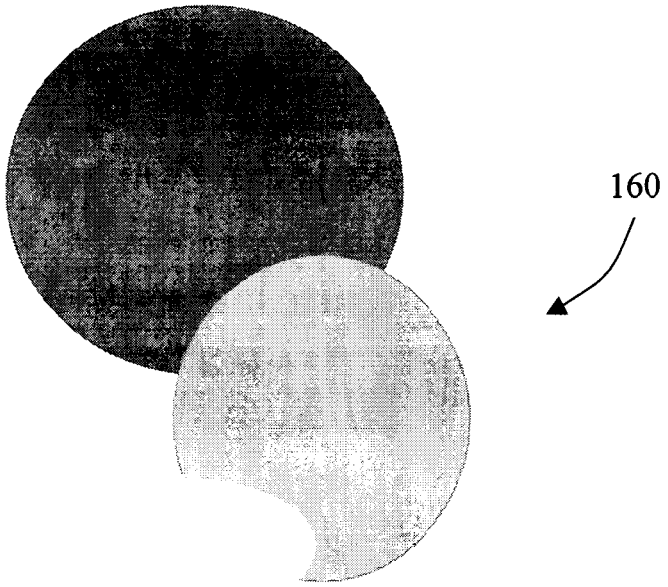
FIG. 9A is an exemplary image used in explaining the invention.
Figure 9B:
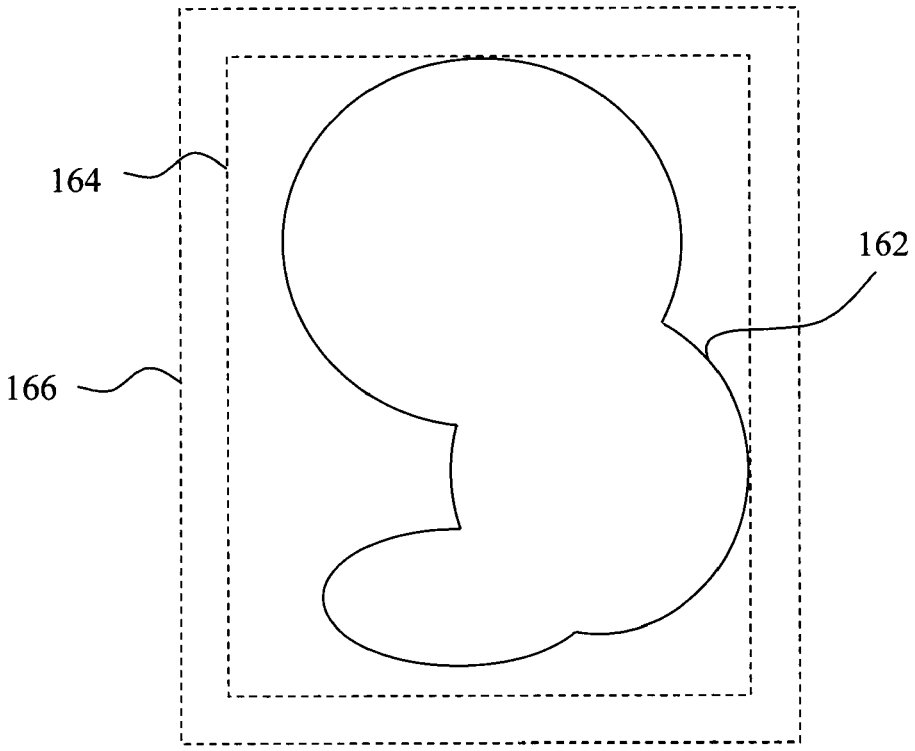
FIG. 9B identifies various exemplary perforation boundaries associated with the image of FIG. 9A.

In one implementation, a boundary detection algorithm may be used to automatically identify the perforation boundary of an image. The boundary detection algorithm may be incorporated, for example, into the printer driver, or may be incorporated into firmware in controller 26. The pseudo code for an exemplary boundary detection algorithm is attached in Appendix A. The pseudo code is in the form of a C++ code snippet that demonstrates how a recursive flood fill algorithm can be used to find the edges of an image. FIG. 9A shows image 160 prior to processing through the boundary algorithm of Appendix A. FIG. 9B shows a boundary 162 of image 160 after processing through the boundary algorithm of Appendix A. As shown, the edges of boundary 162 do not need to be linear, although the edges may be linear. In the example of FIGS. 9A and 9B, image 160 may be, for example, 100 pixels wide by 100 pixels high, and each pixel can be represented by an eight bit value, e.g., an 8 bit paletted bitmap.

If desired, a halo can be drawn around boundary 162 by replacing each edge pixel with a 3×3 block of pixels centered on the original pixel, and then processing the resulting image with the boundary detection algorithm of Appendix A.

Those skilled in the art will recognize that in practicing the present invention other edge detection algorithms well known in the art could be adapted for substitution for the boundary algorithm represented in Appendix A.

In the present implementation, once boundary 162 of image 160 is identified from the graphics data, a plurality of perforation locations may be assigned to the boundary, at a predetermined default perforation resolution, such as for example 100 ppi, which may later be adjusted.

Alternatively, a polygonal perforation perimeter may be defined to surround boundary 162, at a predetermined perforation resolution, wherein a plurality of perforation locations may be assigned to the polygonal perforation perimeter. For example, a polygonal perforation 164, such as a rectangle, may be defined to intersects boundary 162 of image 160 represented in the graphics data at least at one perforation location of the plurality of perforation locations. As another example, the plurality of perforation locations are associated with a polygonal perforation perimeter 166, such as a rectangle, that surrounds boundary 162 of image 160, but does not intersect boundary 162 of image 160.

For example, a rectangular perforation perimeter may be determined by electronically scanning the data representing image 160 (FIG. 9A), or image boundary 162 (FIG. 9B) and recording the Cartesian coordinates (e.g., x,y coordinates) of the highest, lowest, leftmost, and rightmost edge pixel points. Accordingly, one of rectangular perforation perimeters 164 or 166 may be positioned to define a rectangle perforation boundary defining a plurality of perforation locations based on the four pixel points. In one implementation, for example, rectangular perforation perimeter 164 can be sized to intersect all four pixel points.

In another implementation, the embedding may be performed, for example, by perforation software running on computer 12, wherein a user selects a perforation boundary around the image to receive perforations. Such a perforation boundary might be entered, for example, by tracing a light pen around image 160 as presented on the monitor of computer 12, or by entering data points from a keyboard.

Further, as an alternative in the above implementations, it is contemplated that perforation coordinates could be supplied to imaging apparatus 14 via a data packet that accompanies each print job sent to imaging apparatus 14.

At step S206, an identifier is provided for identifying the non-printed color in the graphics data. In particular, at step S206, as mentioned above, software operating on computer 12, such as in the printer driver, automatically embeds the identifier as a predefined color sequence proceeded (or alternatively followed) by the non-printed color, i.e., perforation color, into the graphics data, preferably near the beginning of the graphics data to identity to the graphics data reader which color of a plurality of possible colors serves as the non-printed color, i.e., the perforation color for this perforation job.

At step S208, the graphics data, including the non-printed color, is read, for example, by imaging (perforation) apparatus 14.

At step S210, using the identifier, a plurality of perforation locations are identified by apparatus 14 based on the non-printed color.

At step S212, parameters of the perforation apparatus 14 are adjusted in accordance with the current perforation job.

In one implementation of the invention, the adjusting step may include the step of adjusting a perforation density, e.g., perforations per inch (ppi) of the plurality of perforation locations. The perforation density may be dependent on at least one of a print mode, e.g. draft, normal, etc., a media type and a media thickness of the sheet of print media 30. In addition, by setting the perforation density to a value wherein the perforations, i.e., holes, overlap, then a cut is made.

For example, a plain paper sheet may require less perforation per unit length than a photo paper sheet in order to achieve and acceptable punch-out of the perforated item from the surrounding scrap. Accordingly, for example, plain paper may be perforated at 30 ppi, whereas a photo paper sheet may be perforated at 40 ppi.

As another example, a thin media may require less perforation per unit length than a thick media in order to achieve and acceptable punch-out of the perforated item from the surrounding scrap. Accordingly, for example, thin paper may be perforated at 20 ppi, whereas as poster board may be perforated at 45 ppi.

In another implementation of the invention, the adjusting step may include the step of adjusting a perforation speed of forming the perforations at the plurality of perforation locations. The perforation speed may be adjusted, for example, based on factors such as media type, media thickness, and perforation resolution.

In another implementation of the invention, the adjusting step may include the step of adjusting a perforation force of perforation device 66 that forms the perforations. The perforation force may be determined, for example, by monitoring a motor torque of a motor, e.g., motor 44 of FIG. 1 or motor 142 of FIG. 7, that drives the respective perforation device 66, including tip portion 124 for puncturing the sheet of media 30 to form the perforations.

The motor torque is related to the current drawn by motor 44, 142. Thus, by monitoring the motor current, such as through a simple voltage divider circuit well known in the art, the motor current can be determined, and in turn, the perforation force. Accordingly, the perforation force may then be adjusted automatically to a desired force by adjusting the motor torque. As an example, the perforation force adjustment operation may be performed during a perforation of the sheet of print media sheet at a first perforation location occurrence of the plurality of perforation locations, so that subsequent perforations are formed with the proper perforation force. The motor torque can also be used in setting the perforation density and perforation speed At step S214, the perforation of the sheet of media 30 is performed in accordance with the identifying and adjusting steps, set forth above. The actual perforation may be carried out by perforation system 10, as embodied in one of FIGS. 1 and 7, or alternatively, by some other perforation mechanism known in the art that is reconfigured to operate in accordance with the method of FIG. 8 of the present invention. Along with performing the perforation, the graphics data is printed as an image on the sheet of media 30.

Figure 10:
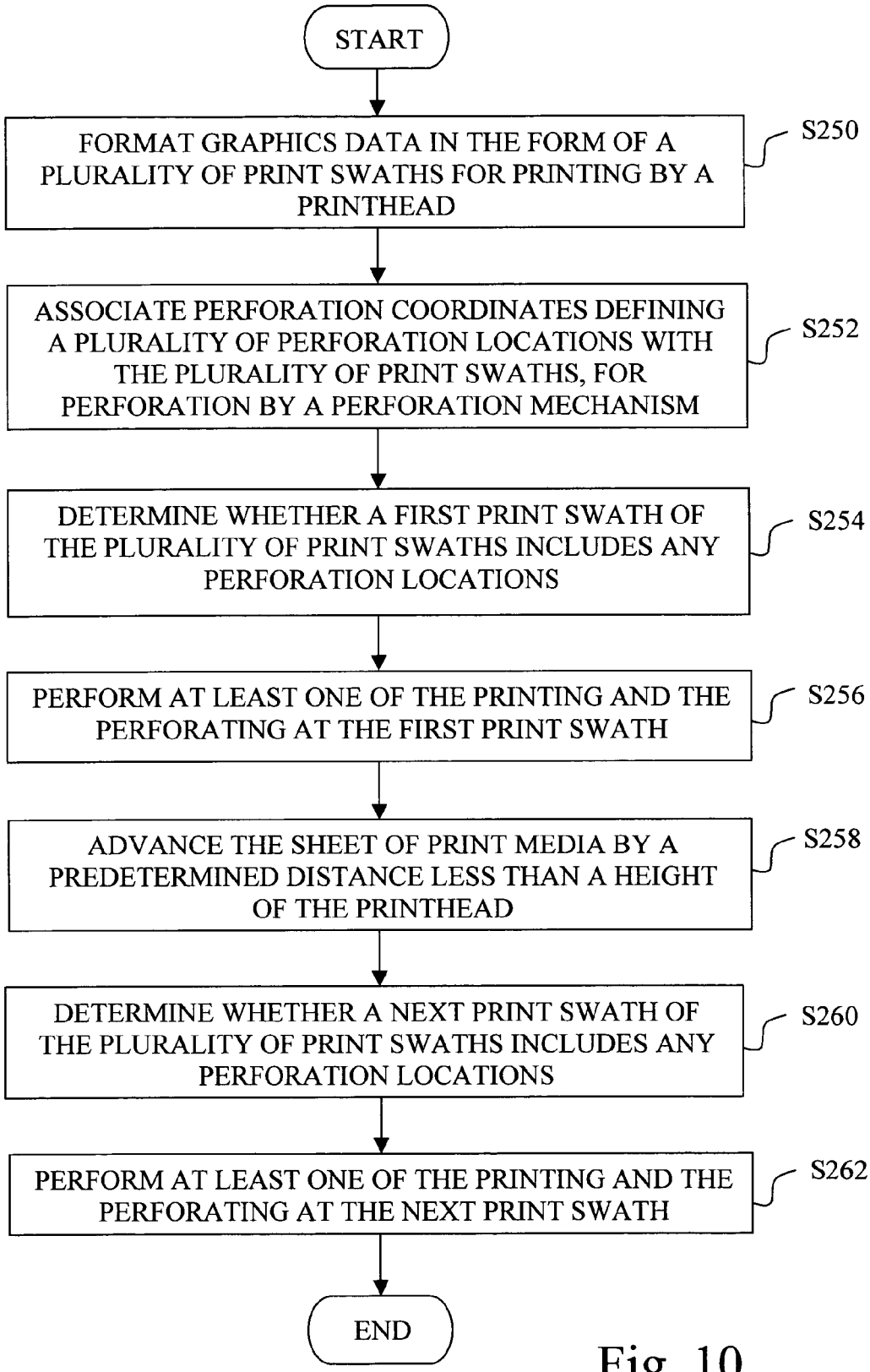
FIG. 10 is a flowchart of another method in accordance with the present invention.

Such combined printing and perforating can be performed sequentially, or can be performed simultaneously, in a given printing swath with system 10 in either of the embodiments of FIGS. 1 and 7. FIG. 10 is a flowchart of an exemplary method for carrying out combined printing and perforating.

The method of FIG. 10 may be carried out in system 10 in either of the embodiments of FIGS. 1 and 7. However, for convenience and ease of understanding, the method of FIG. 10 will be described below with respect to only FIG. 1. It is to be understood, however, that the method of FIG. 10 may be used with the embodiment of FIG. 7 as well.

Imaging apparatus 14 includes carrier system 18 configured to carry a printhead, such as for example, either or both of monochrome printhead 38*a* and color printhead 38*b*, and is configured to carry a perforation forming mechanism, such as perforation forming mechanism 39. In the example that follows, for simplicity, reference will only be made to color printhead 38*b*. During printing, printhead 38*b* is traced over the sheet of print media 30, wherein the area traced by the printhead defines a print swath having a swath height equal to the spacing between the uppermost and lowermost ink jetting nozzles in printhead 38*b*. Typically, the sheet of print media is incrementally advanced by feed roller 58 prior to printhead 38*b* tracing the next print swath. Such concepts are well known in the art. A control unit, which may include the printer driver operating on computer 12 and controller 26 of imaging apparatus, is coupled to printhead 38*b* and to perforation forming mechanism 39.

The control unit is configured to perform the steps set forth in FIG. 10, as follows.

At step S250, graphics data is formatted into a plurality of print swaths for printing by printhead 38*b*.

At step S252, perforation coordinates defining a plurality of perforation locations are associated with the plurality of print swaths, for perforation by perforation forming mechanism 39.

At step S254, it is determined whether a first print swath of the plurality of print swaths includes any perforation locations.

At step S256, at least one of the printing and perforating operations are performed at the first print swath.

At step S258, the sheet of print media 30 is incrementally advanced by feed roller 58 by a predetermined distance less than a height of printhead 38*b*.

At step S260, it is determined whether a next print swath of the plurality of print swaths includes any perforation locations.

At step S262, at least one of the printing and the perforating are performed at the next print swath.

The control unit is further configured to repeat the steps S258, S260 and S262 until the sheet of print media 30 is completely processed.

Figure 11:
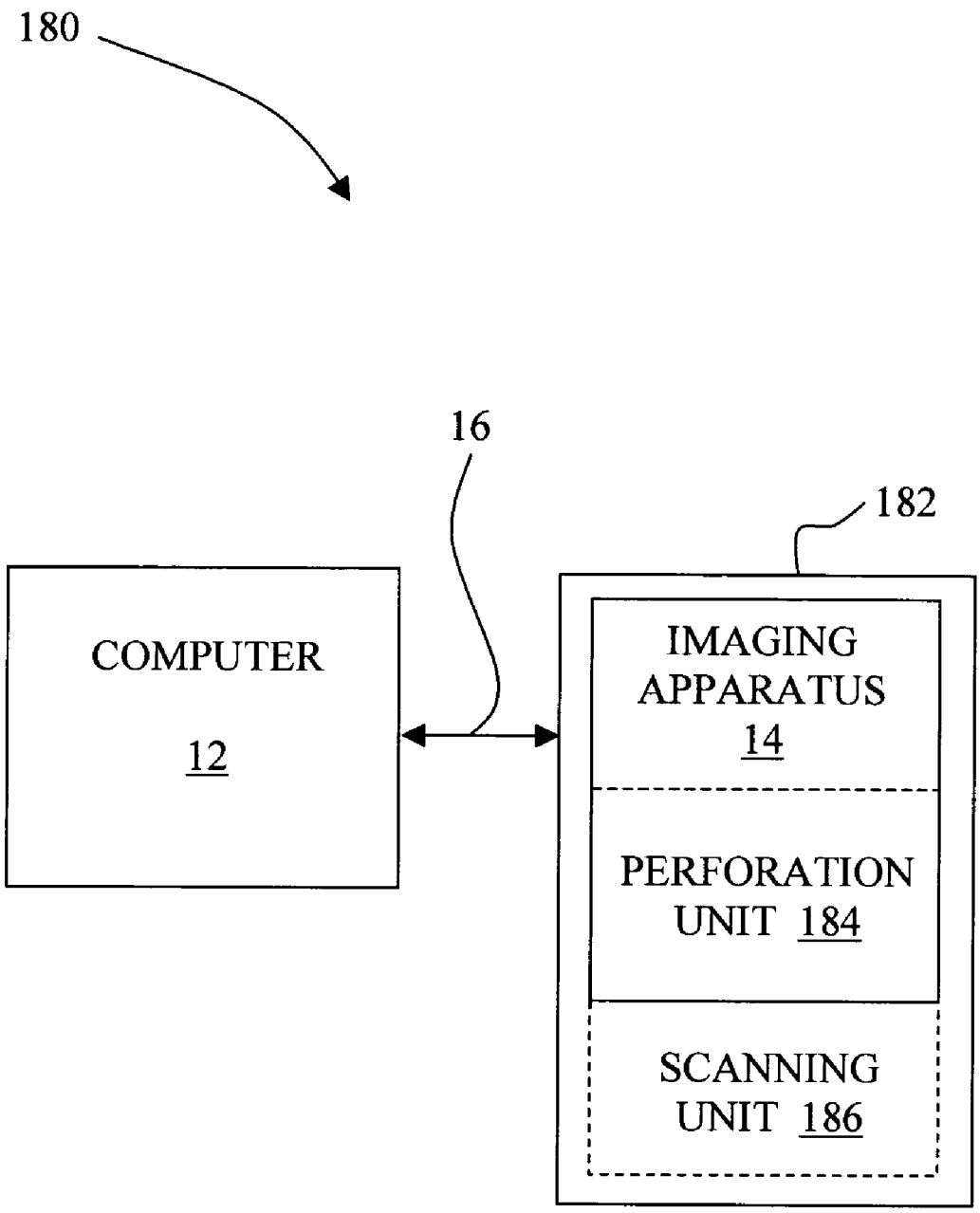
FIG. 11 is block diagram of a perforation system employing an embodiment of the present invention.

FIG. 11 shows another embodiment of the invention. A perforation system 180 includes computer 12 and a perforation apparatus 182. Apparatus 182 includes imaging apparatus 14, a perforation unit 184, and a scanning unit 186. Computer 12 is communicatively coupled to perforation apparatus 182 via communications link 16. Perforation unit 184 may be, for example, the perforation cartridge 34*c* as described above with reference to FIG. 1, or may be the perforator carriage 134 and its associated mechanisms, as described above with respect to FIG. 7. Scanner unit 186 may be, for example, a commercially available stand alone scanner, or a similar scanning unit physically incorporated into imaging apparatus 14. Perforation system 180 may be operated, for example, in accordance with the method described below with respect to FIG. 12.

Figure 12:
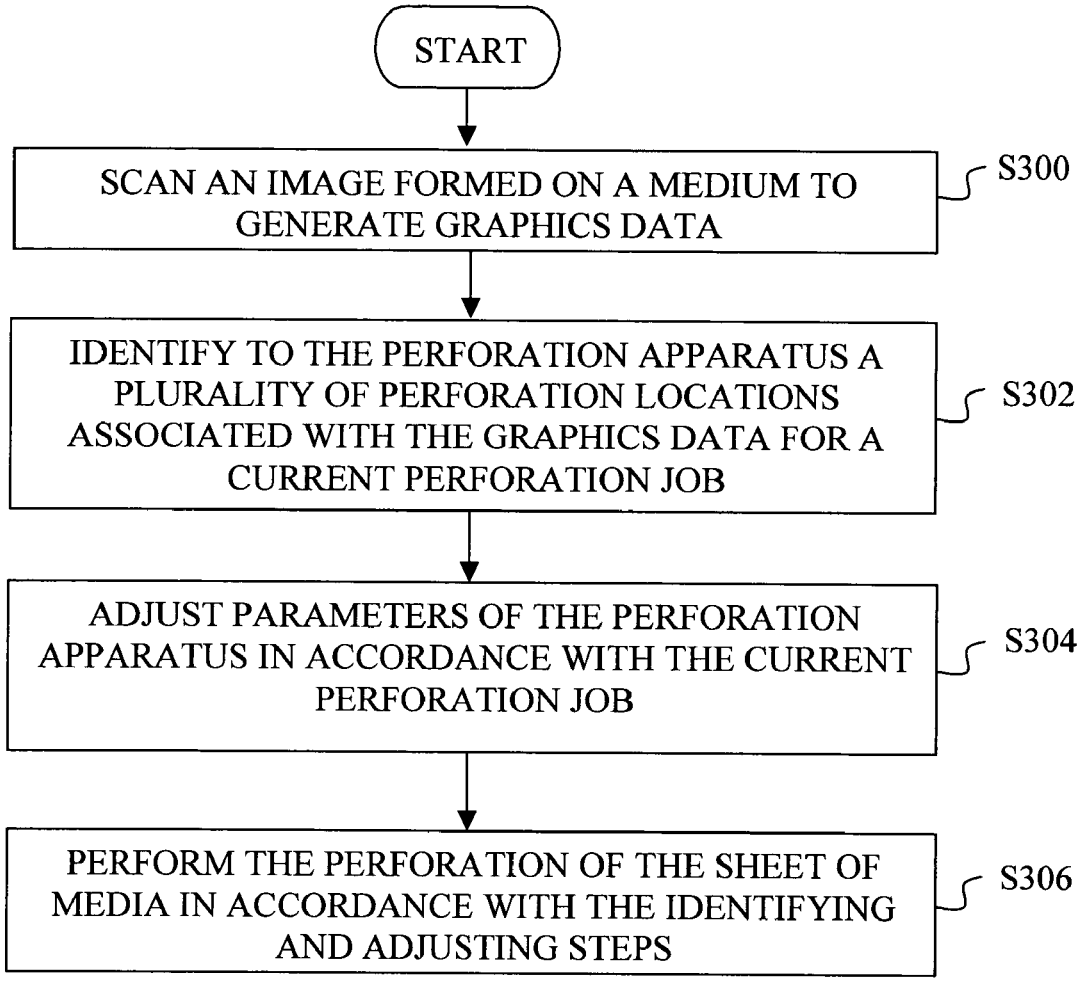
FIG. 12 is a flowchart of still another method in accordance with the present invention.

The method for forming perforations in a sheet of media, as illustrated in the flowchart of FIG. 12, will be described below in conjunction with FIGS. 9A, 9B and 11.

At step S300, an image, such as image 160 of FIG. 9A that is formed on a medium, such as the sheet of print media 30, is scanned by scanning unit 186 to generate graphics data.

At step S302, a plurality of perforation locations associated with the graphics data is identified to perforation apparatus 182 for a current perforation job. Step S302 may be performed, for example, by utilizing the method steps S202, S204, S206, S208 and S210 of FIG. 8. Alternatively, methods known in the art for identifying perforation locations to a perforation apparatus could be adapted for performing step S302.

At step S304, parameters of perforation apparatus 182 are adjusted in accordance with the current perforation job. The parameter adjustment of step S304 may be performed, for example, in a manner as described above in step S212 of FIG. 8

At step S306, perforation of the sheet of media 30 is performed in accordance with identifying step S302 and adjusting step S304. Along with performing the perforation, the graphics data may be printed as an image on the sheet of media 30. Such combined printing and perforating can be performed sequentially, or can be performed simultaneously, in a given printing swath with system 10 in either of the embodiments of FIGS. 1 and 7. Step S306 may be performed, for example, in a manner as described above in step S214 of FIG. 8.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

APPENDIX A

Boundary Detection Algorithm, in C++ Programming Language

```
int Width=100, Height=100;
int Background, Data, Marked, Edge;
short int ImageBuffer[Width][Height];
void flood(int x, int y)
{
  int head, tail,i;
// if the current pixel is Marked or Edge escape out of routine
  if (ImageBuffer[x][y]==Marked) return;
  if (ImageBuffer[x][y]==Edge) return;
// if the current pixel is Data, mark it as Edge and return
  if (ImageBuffer[x][y]==Data){
        ImageBuffer[x][y]=Edge;
    return;
  }
// find left edge of screen or data on left side
  head=x;
  while ( (ImageBuffer[head][y] ==Background) && (head > 0)){
    head--;
  }
  if(ImageBuffer[head][y]==Data){
      ImageBuffer[head][y]=Edge;
  }
  if(head) head++;
// find right edge of screen or data on left side
  tail=x;
  while ( (ImageBuffer[tail][y]==Background) && (tail < (Width-1))){
    tail++;
  }
  if(ImageBuffer[tail][y]==Data){
          ImageBuffer[tail][y]=Edge;
  }
  tail--;
  if(head>tail) {
    head=x;
    tail=x;
  }
// set from head to tail to Marked
  for(i=head;i!=(tail+1);i++) ImageBuffer[i][y]=Marked;
// look for open pixels above
  if(y>0) {
    for(i=head;i!=(tail+1);i++) flood(i,y-1);
  }
```

APPENDIX A-continued

Boundary Detection Algorithm, in C++ Programming Language

```
// look for open pixels below
  if(y<Height) {
    for(i=head;i!=(tail+1);i++) flood(i,y+1);
  }
}
int main( ) {
 int x, y;
 unsigned char ch;
 int loop,z;
// read image into ImageBuffer
 ReadImageIntoImageBuffer( );
// change every pixel to either Background or Data
 for(y=0;y!=Height;y++) {
        for(x=0;x!=Width;x++) {
            ch=ImageBuffer[x][y];
          if((x==0) && (y==0)) {
              Background=ch;
              Data=(Background+20) & 0xff;
              Marked=(Background + 40) & 0xff;
              Edge=(Background + 70) & 0xff;
          }
          if(!(ch==Background)) ch=Data;
            ImageBuffer[x][y]=ch;
    }
  }
// ok, now we're ready to do the flood fill
  flood(1,1);
// go to only background and edges
  for(y=0;y!=Height;y++) {
        for(x=0;x!=Width;x++) {
            if(ImageBuffer[x][y]!=Edge) ImageBuffer[x][y]=Background;
    }
  }
        return 0;
}
```

What is claimed is:

1. A method for forming perforations in a sheet of media with a perforation system, comprising the steps of:

scanning an image formed on a medium to generate graphics data;

identifying to said perforation system a plurality of perforation locations associated with said graphics data for a current perforation job;

adjusting parameters of a perforation apparatus in accordance with said current perforation job; and performing perforation of said sheet of media in accordance with said identifying and adjusting steps.

2. The method of claim 1, said identifying step further comprising the step of associating said plurality of perforation locations with a boundary of said image.

3. The method of claim 1, said identifying step further comprising the step of associating said plurality of perforation locations with a polygon that intersects a boundary of said image at least at one perforation location.

4. The method of claim 3, wherein said polygon is a rectangle.

5. The method of claim 1, said identifying step further comprising the step of associating said plurality of perforation locations with a polygon that surrounds a boundary of said image but does not intersect said boundary of said image.

6. The method of claim 5, wherein said polygon is a rectangle.

7. The method of claim 1, said adjusting step further comprising the step of adjusting a perforation density of said plurality of perforation locations.

8. The method of claim 7, wherein said perforation density is dependent on at least one of a print mode, a media type and a media thickness.

9. The method of claim 7, wherein said perforation density is set to form a cut.

10. The method of claim 1, said adjusting step further comprising the step of adjusting a perforation speed of forming said perforations at said plurality of perforation locations.

11. The method of claim 1, said adjusting step further comprising the step of adjusting a perforation force of a perforation device that forms said perforations.

12. The method of claim 11, wherein said perforation force is determined by monitoring a motor torque of a motor driving said perforation device.

13. The method of claim 1, wherein said adjusting step further comprises the steps of:

providing a motor coupled to a perforation device, said perforation device including a tip portion for puncturing said sheet of media to form said perforations;

monitoring a motor torque of said motor as said perforation device punctures said sheet of media;

associating said motor torque with a perforation force required for said perforation device to puncture said sheet of media; and adjusting at least one of said perforation force, a perforation density and a perforation speed based on said motor torque.

14. The method of claim 13, wherein the step of adjusting said perforation force is performed at a first perforation location occurrence of said plurality of perforation locations.

15. The method of claim 1, said identifying step further comprising the step of:

defining a non-printed color to represent said plurality of perforation locations;

embedding said non-printed color in said graphics data for said current perforation job; and providing an identifier for identifying said non-printed color in said graphics data.

16. The method of claim 15, wherein said identifier is a color sequence associated with said non-printed color.

17. The method of claim 1, wherein along with performing the step of performing perforation, said method further comprising the step of printing said graphics image on said sheet of media.

18. The method of claim 17, wherein said perforation and said printing are performed simultaneously for a given printing swath.

19. The method of claim 17, wherein said perforation and said printing are performed sequentially for a given printing swath.

20. A perforation system for forming perforations in a sheet of media, comprising:

a scanner for scanning an image formed on a medium to generate graphics data;

a computer communicatively coupled to said scanner, said computer configured to identify a plurality of perforation locations associated with said graphics data for a current perforation job; and an apparatus communicatively coupled to said computer, said apparatus including a perforation mechanism, said apparatus being configured for performing the steps of:

adjusting perforation parameters in accordance with said current perforation job; and perforating said sheet of media in accordance with said adjusting step.

21. The perforation system of claim 20, said apparatus being configured to perform the step of printing said graphics image on said sheet of media along with performing the step of performing perforation.

22. The perforation system of claim 20, wherein said adjusting step comprises adjusting a perforation density of said plurality of perforation locations.

* * * * *